US007503352B2

(12) United States Patent
Vanderjeugt et al.

(10) Patent No.: US 7,503,352 B2
(45) Date of Patent: Mar. 17, 2009

(54) DEVICE AND METHOD FOR LOCKING THE CONNECTION OF A HEDDLE TO A HARNESS CORD

(75) Inventors: Bram Vanderjeugt, Ieper (BE); Gunther Devloo, Lichtervelde (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 133 days.

(21) Appl. No.: 11/487,676

(22) Filed: Jul. 17, 2006

(65) Prior Publication Data

US 2007/0028986 A1 Feb. 8, 2007

(30) Foreign Application Priority Data

Jul. 15, 2005 (BE) ..... 2005/0360

(51) Int. Cl.
*D03D 47/20* (2006.01)
*D03D 47/23* (2006.01)

(52) U.S. Cl. ..... 139/448; 139/437; 139/116.1; 139/439; 139/216

(58) Field of Classification Search ..... 139/55.1, 139/82–91, 116.1, 437, 438–439, 443–448, 139/450, 216; 26/93, 94; 28/208
See application file for complete search history.

(56) References Cited

U.S. PATENT DOCUMENTS 6,880,582 B2 * 4/2005 Vanderjeugt et al. ..... 139/88
7,025,094 B2 * 4/2006 Vanderjeugt et al. ..... 139/59
7,168,454 B2 * 1/2007 Vanderjeugt ..... 139/55.1
2003/0188795 A1 10/2003 Lemfeld et al.
2003/0221737 A1 * 12/2003 Vanderjeugt et al. ..... 139/88
2004/0003859 A1 * 1/2004 Vanthournhout et al. ..... 139/85
2004/0159361 A1 * 8/2004 Vanderjeugt ..... 139/91
2005/0081940 A1 * 4/2005 Vanthournout et al. ..... 139/55.1
2006/0065321 A1 * 3/2006 Vanderjeugt ..... 139/55.1

FOREIGN PATENT DOCUMENTS

| | | |
|---|---|---|
| EP | 0932713 | 8/1999 |
| FR | 2822479 | 9/2002 |
| FR | 2855838 | 12/2004 |
| GB | 1228269 | 4/1971 |
| GB | 1413950 | 11/1975 |

* cited by examiner

*Primary Examiner*—Bobby H Muromoto, Jr.
(74) *Attorney, Agent, or Firm*—James Creighton Wray

(57) ABSTRACT

Device for locking the connection of a heddle (40) to a harness cord (50), having a heddle side and a harness cord side. The device is composed of at most two different components, the device having a diameter on the heddle side and/or on the harness cord side which decreases towards the end. The device is releasable and recloseable, allowing the device to be reused. The components are made from a plastics material which has a high wear resistance. The device is provided over virtually its entire length with a continuous passage (4) for guiding a heddle and a harness cord.

27 Claims, 12 Drawing Sheets

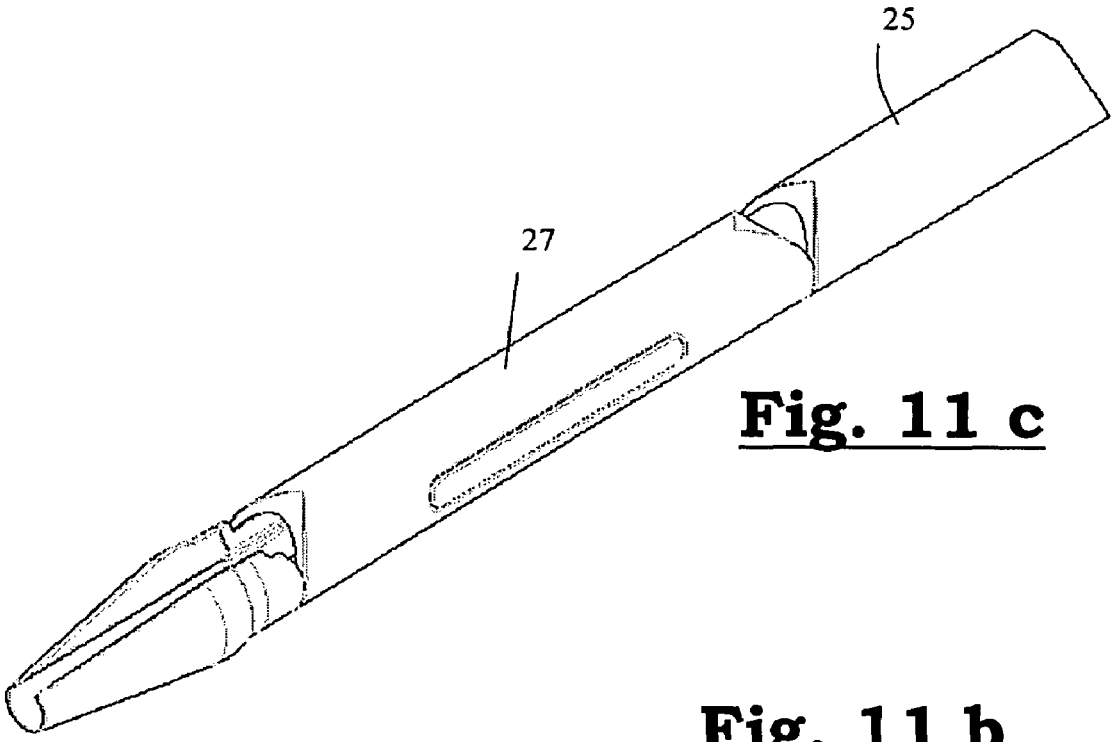
Fig. 11 c
Fig. 11 b
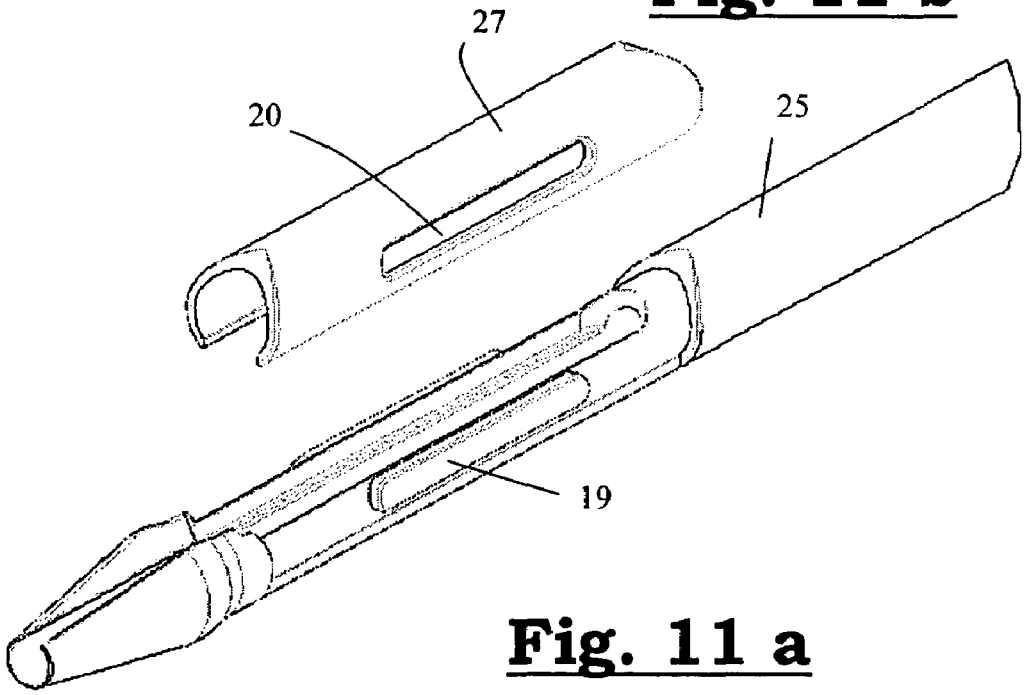
Fig. 11 a

DEVICE AND METHOD FOR LOCKING THE CONNECTION OF A HEDDLE TO A HARNESS CORD

This application claims the benefit of Belgian Application No. 2005/0360 filed Jul. 15, 2005, which is hereby incorporated by reference in its entirety.

BACKGROUND OF THE INVENTION

The present invention relates firstly to a device for locking the connection of a heddle to a harness cord. Secondly, the present invention relates to a method for locking the connection of a heddle to a harness cord and to a Jacquard weaving machine provided with a device of this type for connecting a heddle to a harness cord.

In a Jacquard weaving machine, warp yarns are passed through the eye of a heddle, the Jacquard loom moving the heddles up and down by coupling or not coupling hooks to blades moving up and down in opposite phase, these hooks being connected to tackle cords in a tackle system. The tackle system is in turn connected to harness cords which are connected to the heddles. To lock the coupling between hook and blade during the movement of the hook with a blade, the heddles are connected at the bottom to return springs.

As has already been mentioned, on their top side the heddles are each connected to a harness cord. This connection is made by providing a securing element, which is an eye, a resilient fold-back, a clamping element, etc., at the end of the heddle, allowing the harness cord to be clamped in the securing element of the heddle or the harness cord to be wound around the securing element of the heddle and the folded-back harness cord to be connected to the incomer so as to form an eye in the harness cord.

These connections are made during the levelling of the eyes of the heddles through which the warp yarns extend. During levelling, the connection between the heddle and the harness cord is positioned in such a way that the heddle eye through which the warp yarn extends is in a position at a defined height with respect to the weft introduction means, in order to allow successful shed formation over the entire woven fabric. For this purpose, usually all the heddle eyes are positioned into the same defined height position.

In order firstly to ensure that these connections do not become loose and secondly to prevent the projecting parts of the connection from colliding with the heddles and cords located next to one another during the movement up and down, the prior art has disclosed various designs and methods for connecting the heddle to the harness cord and for locking this connection.

First of all, French patent publication FR 2212891 describes how a sleeve is arranged around the connection between heddle and harness cord, the sleeve being slid over one of the two components before they are connected. If, after the levelling of this heddle, the harness cord is connected to the heddle, the sleeve is moved over the connection and irradiated with a heat source. Since the sleeve is made from a material which shrinks under the influence of heat, the sleeve will stretch over the cord/heddle connection. The connection can only be broken by destroying the sleeve. When weaving in relatively high densities, the sleeve around one connection collides with adjacent connections between heddle and harness cord. Material which shrinks under the influence of heat is also less wear-resistant than certain other plastics materials which do not permit shrinkage through heat, with the result that collisions between the various sleeves quickly lead to wear, limiting the operating life time of the harness. The ends of the sleeves also have rather sharp corners, with the result that when the top side of one sleeve collides with the underside of the other sleeve, the sleeve is damaged, which leads to compression of material and accelerated wear to the connection. For this reason, the sleeves are designed to be slightly longer than the stroke of movement of the heddles, so that the said collisions cannot occur.

Long sleeves are expensive, cause problems during assembly and may be critical for determining the length of heddles or cords and may therefore have an adverse effect on the overall installed height of a Jacquard weaving machine. The connection can only be undone by destroying the sleeve.

European patent EP 0 932 713 describes an embodiment in which shorter shrink-fit sleeves can be used. Since the sleeves are pushed over an auxiliary piece at the bottom, the auxiliary piece being made from a more wear-resistant, non-shrinking plastic material and having a cross section which decreases in the downwards direction, there are no sharp comers on the ends. If adjacent heddles then move past one another and collisions occur between an auxiliary piece of this type and the top side of the sleeves around adjacent connections, the collision is prevented in this way from being front-on, which has a beneficial influence on the operating lifetime of the sleeves and the operating life time of the harness. However, the sleeves are still made from a material that is not very wear-resistant and are still subject to most wear at their free ends and at the location of the connection of the heddle to the harness cord, since there is a local projection there, and furthermore it remains the case that the connection can only be undone by destroying the sleeve.

Where in EP 0 932 713 the bottom piece is provided in sliding form by being made from wear-resistant plastics material, FIG. 6 of European patent publication EP 0 915 195 proposes a similar design on the heddle, the connection between the heddle and the wear-resistant plastic component, as the cross section decreases in the downwards direction, being fixedly connected to the heddle and also performing the function of the bottom wear-resistant plastic component, which is to reduce the effect of collisions. In this case too, a shrink-fit sleeve is used, first of all being arranged over the harness cord before being connected to the clamping part which is connected to the heddle and is slid downwards after this connection has been made. The same drawbacks apply here as were mentioned in the context of the discussion of EP 0 932 713.

French patent publication FR 2 822 479 describes a design for higher densities, in which, in addition to the wear-resistant plastic element at the bottom, an element is also provided at the top, having a cross section which decreases in the upwards direction, in order to avoid sharp corners. The said element includes a slot for clamping the harness cord after levelling, by sliding a sleeve, which connects the wear-resistant plastic element at the top and the bottom, over it in a clamping manner.

This embodiment requires three components to realize a clamping shield around the connection between heddle and harness cord, in which the sleeve may be shrunk-on or may be a tubular sleeve. On account of its limited wall thickness, the sleeve, over its entire length, is less stable and less wear-resistant than the injection-moulded elements at the top and bottom. The use of three components is also very laborious and time-consuming, making the operation particularly expensive.

US patent publication 2003/0188795 describes a solution comprising three parts, all the parts being made from a wear-resistant plastic and in their assembled form being responsible for retaining the connection between heddle and harness cord and for offering sufficient strength and operating life time for high densities of heddles and harness cords moving next to one another. One drawback which continues to be associated with this solution is that there are also three components, making the solution expensive and also making fitting to the connection laborious. Thus, the first part is placed on the heddle (without the securing element on the heddle being passed through the groove), after which the second part is then pushed over the end of the first part until it is clamped thereon, after which the first and second parts can be slid downwards over the heddle in order to make the connection to the harness cord onto which the third part has already been pushed. After this connection has been made, the third part is connected to the first and second parts which have already been connected.

A drawback of the designs and methods described above is that the mounting of the known devices on the connection between the heddle and a harness cord is very laborious and time-consuming.

SUMMARY OF THE INVENTION

The object of the present invention is to provide a device for locking the connection of a heddle to a harness cord which also retains the connection between heddle and harness cord successfully and is simple to fit, and which also does not have any sharp edges on the heddle side or on the harness cord side.

The object of the invention is achieved by providing a device for locking the connection of a heddle to a harness cord comprising a heddle side and a harness cord side, wherein the device is composed of at most two different components, the device having a diameter on the heddle side and on the harness cord side which decreases towards the end until the diameter virtually matches the heddle or the harness cord, respectively, and the device being releasable and recloseable. This allows simple assembly of the device, while the device can also keep the force of collisions between adjacent devices at a low level. The device is releasable and recloseable, allowing the said device to be reused. Moreover, when replacing a heddle or harness cord, after the device has been opened and the heddle or harness cord has been replaced, the device can be closed again, retaining its original properties.

Another object of the invention is to provide a device for locking the connection between a heddle and a harness cord having one or more characteristics of the present invention which has a long operating life time, even for Jacquard weaving machines which weave in a high density.

This object is achieved by providing a device according to the invention in which there are at most two different components, each made from a plastics material which has a high wear resistance. The device according to the invention is preferably made from high-quality polypropylene, polyamide and/or polyacetal.

An additional object is to provide a device for locking the connection between a heddle and a harness cord having one or more characteristics of the present invention but which also successfully ensures the connection between heddle and harness cord, is simple to assemble and is reusable in the event of a heddle or harness cord having to be replaced.

A first preferred device of the invention is achieved by providing a device according to the invention, wherein the device is provided over virtually its entire length with a continuous passage for guiding a heddle and a harness cord, the continuous passage being composed of a:

first part provided on the side where the heddle enters the device in the final assembled state;

second part provided on the side where the harness cord enters the device in the final assembled state;

a third part, located between the said first part and second part.

In a second preferred device according to the invention, the continuous passage in the first part is provided, over at least part of its length, with a passage cross section of a shape which virtually corresponds to the shape of the cross section of the heddle, so that this part of the passage can be slid over a heddle.

As is described in the prior art, the heddle is always provided with a connecting element which in at least one direction has a larger cross section than the cross section of the heddle over the majority of its length. This connecting element can be designed as an eye, an attachment piece or a fold-back which can be realized before or during the production of the connection and is provided for the purpose of receiving a harness cord and to subsequently lock this connection using a device according to the invention, the lock being effective both when Jacquard weaving machines are inoperative and when they are operating.

In a third preferred device according to the invention, the continuous passage in the second part is provided, over at least part of its length, with a passage cross section of a shape which virtually corresponds to the shape of the cross section of the harness cord, so that the second part of the said passage can be slid over a harness cord or so that a harness cord can be clamped in the second part of the said passage.

In a particularly preferred device, the continuous passage in the third part is closed over at least part of its length (in the context of the present patent application, this is to be understood as meaning that over this part of its length the passage does not have a groove between the passage and the outer wall of the device), and the third part has a larger passage cross section than the passage cross sections of the first and second parts. In a particular embodiment, the passage cross section of the third part is variable over its length.

Since the connecting element on the heddle permits elastic deformation in order to clamp the harness cord, the third part, in a more particular device, over at least part of its length has a passage cross section with a smaller diameter than the larger passage cross section of the third part, which is intended to act in a clamping manner on a connecting element provided on the heddle. The clamping action preferably takes place at the location where this passage cross section with a smaller diameter extends around the connection of the heddle connecting element to the harness cord, at the end of the cycle of fitting the device to the connection of heddle and harness cord.

In a preferred embodiment of the device according to the invention, the first part and/or the second part comprises a groove, connected to the continuous passage. The groove in the first part enables the heddle together with its connecting element to be introduced from the heddle side. Preferably, the said groove comprises a first groove portion and a second, adjacent groove portion with a greater width than the first groove portion, the first groove portion being located at one end of the device. This is particularly advantageous if, for example, the heddle comprises two wires located next to one another, with the result that the heddle has a cross section which is wider in one direction than in the other direction. If the connecting element on the heddle has a projection which is wider in a different radial direction, a wider groove is useful, since a differently oriented widening of this type is easier to insert. If the first groove section has a width which is matched to the narrowest side of the heddle, a wider second groove section is required if the connecting element has a projection with a different orientation from the wide side of the heddle itself. The connecting element can be introduced obliquely into this wider second groove portion, after which the heddle is laid back according the axis line of the device, with the result that the heddle is introduced into the groove and guided to the continuous passage.

The widening (second groove portion) in the second part of the continuous passage permits the connecting element of the heddle, which after levelling has been connected to the introduced harness cord, to be introduced obliquely into the third part of the continuous passage until the device is pushed over the connecting element into the portion of the third part with a smaller diameter than the larger passage cross section of the third part, in which the connecting element together with the harness cord are sufficiently clamped.

In order, after the harness cord has been connected to the heddle, for the connecting element on the heddle, with the harness cord connected to it, to be introduced into the device from the top side, in a more preferred embodiment of the device according to the invention the continuous passage is provided with at least two lips in the second part, at its end. The lips are designed in such a way that the harness cord can be pushed through the lips in the continuous passage by means of a compressive force, while a force greater than the lateral forces on the harness cord during normal operation of the Jacquard weaving machine is required to move the cord out of the passage through the lips.

In an advantageous embodiment of the device according to the invention, the device is composed of one component. This allows simple and inexpensive fitting of the device. Furthermore, the connection can be opened again by exerting sufficient force on the harness cord to push it back out of the lips along the groove, to position it more obliquely and to slide the connecting element on the heddle connected to the harness cord out of the device.

In a particularly advantageous embodiment, the device is composed of one component, which is of benefit to the cost price of the device and also the simplicity of production of the device.

In a more advantageous embodiment of the device, the second part of the continuous passage comprises at least one pivoting part for receiving the harness cord in the second part of the continuous passage. As a result, as early as during the oblique introduction of the connecting element of the heddle to which the harness cord is connected, the harness cord can be laid in the pivoting portion and this pivoting part, together with the harness cord, can be folded towards the axis line of the device (which coincides with the direction in which the passage extends).

In a first preferred embodiment, the second part comprises a pivoting part and a stationary part, the stationary part being provided for the purpose of holding the pivoting part in a fixed position. This makes it easier to move the harness cord in the axis line of the device. The stationary part is preferably provided for the purpose of clamping the pivoting part, so that the latter clamps the harness cord in position in the passage. This allows the harness cord to be placed in the pivoting part using lower compressive forces, in order nevertheless to realize a significant clamping force on the device after the latter has been closed, by the pivoting part being folded shut.

In a more preferred embodiment of the device according to the invention, the pivoting part is provided with one or more projections which fit into corresponding openings in the stationary part, in such a manner that the stationary part can hold the pivoting part clamped in a fixed position. This locks the device against clamping on the harness cord being lost. As a result of the projections on the pivoting part being pressed back out of the openings in the stationary part, the pivoting part can fold open again, with the result that the heddle/harness cord connection can be released again, and the device according to the invention can be reused after the connection has been opened for the replacement of a heddle or a harness cord.

For guiding the pivoting part towards the stationary part, the stationary part is provided, in a preferred embodiment, with a guide groove, which is realized in particular at least by the projections which fit into the recesses. In addition to the guidance of the pivoting part towards its clamping in the device, the said guide groove can also exert additional clamping on the pivoting part. For this purpose, in a particularly preferred embodiment the stationary part has a wall thickness which varies over the circumference, the maximum wall thickness occurring at right angles to the groove. In this way, the stationary part is strongest in the positions at right angles to the groove, so that in this position the highest force is exerted on the pivoting part and the harness cord is most securely clamped in this pivoting part after the pivoting part has been received in clamping fashion in the stationary part.

In particular, the cross section of the stationary part is circular on its inner wall (passage cross section) and elliptical on its outer wall.

In a particularly advantageous embodiment of the device according to the invention, the device is produced by an injection moulding process. It is preferable for the pivoted connection to be integrated in the plastic injection moulding, which means that there is no need for any additional components to realize a pivoted connection. If the pivoting part is also injection-moulded in the plastics piece, the pivot line is straighter and more aligned if, according to a preferred embodiment, at the transition from the pivoting part of the second part of the continuous passage to the fixed third part of the continuous passage, the pivoting second part and/or the fixed third part are provided on the outer side with a flat side, with the pivot line between the two parts forming part of said flat side(s). This prevents a different pivot line being formed each time in the event of repeated pivoting and prevents the pivoting section in each case adopting a different position. The pivot line is even more clearly aligned if the guide groove in the stationary part has additional recesses immediately after the pivot line.

The portion above the pivot line may in particular also be provided at the top in the longitudinal direction with a projection which seals the guide groove when the pivoting part is being folded shut, so that in the final assembled state the device is closed at its end, which has the advantage of fewer sharp edges as a function of collisions with adjacent devices.

In another preferred embodiment of the device according to the invention, the second part is composed of two components, the said components preferably being connected to one another via a click-fit connection, and one component also comprising the first part and the third part.

In a first preferred embodiment, the said components are provided with an axial groove for radially connecting the said components to one another.

In a second preferred embodiment, the second part is composed of a separate component, which is provided with a groove in which the harness cord can slide, and a clamping component, of which the third part and the first part also form part, the clamping component being provided with a groove for axially connecting the said components to one another. The separate component comprises in particular one or more projections which fit into corresponding openings in the clamping component, in such a manner that the clamping component can exert a clamping force on the axially inserted separate component.

A further subject of the present patent application is a method for locking the connection of a heddle to a harness cord, wherein a device according to one of claims 1 to 25 is used to lock the connection of a heddle to a harness cord.

The present patent application also relates to a Jacquard weaving machine provided with a harness device, wherein a device according to one of claims 1 to 25 is used to lock the connection of a heddle to a harness cord.

To provide a further explanation of the properties of the present invention and to indicate additional advantages and details thereof, there now follows a more detailed description of various embodiments of a device according to the invention. It will be clear that nothing in the description which follows may be interpreted as a restriction to the scope of protection for the device according to the invention as laid down by the claims.

Furthermore, some of these embodiments are discussed in the accompanying figures, reference being made to these figures by means of reference symbols, and in the drawings:

BRIEF DESCRIPTION OF THE DRAWINGS

FIGS. 1*a* to *d* illustrate a complete device according to the Invention comprising one component, FIG. 1*a* showing a front view also illustrating the heddle and harness cord, while FIG. 1*b* shows a side view with a symbolic representation of heddle and harness cord, FIG. 1*c* shows a cross section through a first part and FIG. 1*d* shows a cross section through a second part;

FIGS. 2*a* to *c* and 5*a* to *c* illustrate the first part of the continuous passage, wherein:

FIGS. 2*a* to 5*a* show a cross section through a front view;

FIGS. 2*b* and 5*b* show a top view;

FIGS. 2*c* and 5*c* show an isometric view;

FIG. 3 illustrates the centre part of the continuous passage;

FIGS. 4*a* to *h* illustrate the various steps involved in realizing and locking the connection of a heddle to a harness cord using a device according to the invention;

FIGS. 10 and 11 illustrate a second part of the continuous passage, the device being designed as two components, the second component being pushed radially onto the first component in order to lock the connection between heddle and harness cord;

DETAILED DESCRIPTION OF THE PREFERRED EMBODIMENTS

The invention consists in the use of a device for locking the connection between a heddle (40) and a harness cord (50), which comprises preferably one and at most two different components, the device having a diameter which decreases towards the end both on the heddle side and on the harness cord side.

The device is preferably reusable by being designed such that, in the event of a heddle or harness cord being replaced, after the device has been opened and the heddle or harness cord has been replaced, the device can be closed again, retaining its original properties.

Furthermore, the device is preferably made from a plastics material with a high wear resistance, such as preferably: high-quality polypropylene, polyamide and/or polyacetal.

Figures 1A, 1B, 1C, 1D:
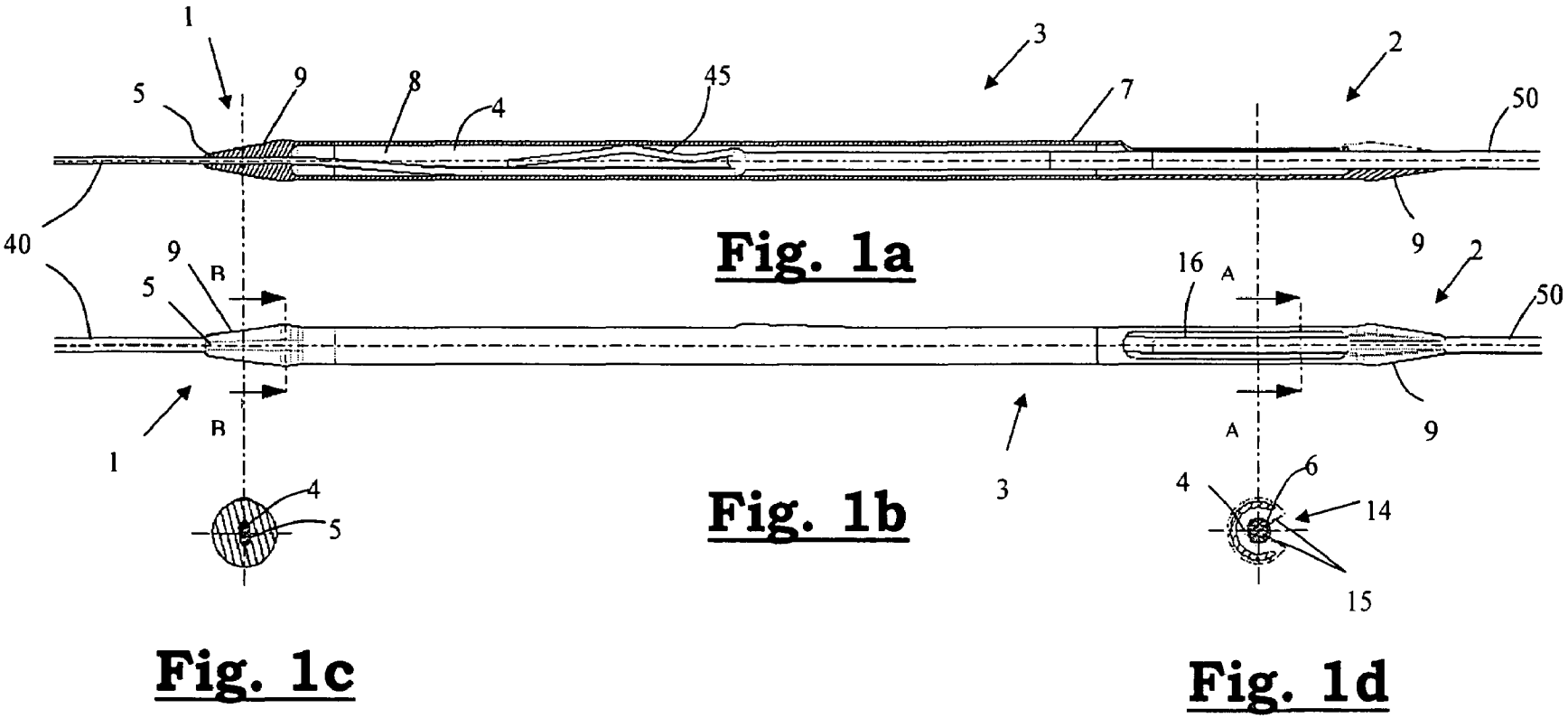

The device, and as illustrated in FIG. 1, is provided over virtually its entire length with a continuous passage (4) for guiding a heddle (40) and a harness cord (50). As has been described in the prior art, the heddle is always provided at the top with a connecting element. This connecting element (45) may be designed as an eye, an attachment piece or a fold-back (45), which can be realized before or during the connection being made and is intended to receive and connect a harness cord (50) in order for this connection subsequently to be locked using a device according to the invention, the locking being effective both when Jacquard weaving machines are inoperative and when they are operating.

The said continuous passage (40) is composed of a:

- first part (1) provided on the side where the heddle (40) enters the device in the final assembled state (also referred to as the bottom of the device);
- second part (2) provided on the side where the harness cord (50) enters the device in the final assembled state (also referred to as the top of the device);
- third part (3), which is located between the first part (1) and the second part (2).

Over at least part of its length, the first part (1) is provided with a cross section of a shape which virtually corresponds to the shape of the cross section (5) of the heddle (40), so that this part of the passage can be slid over a heddle.

Furthermore, the passage (4) in the second part (2) is provided, over at least part of its length, with a cross section of a shape which virtually corresponds to the shape of the cross section (6) of the harness cord (50), so that the second part (2) can be slid over a harness cord (50) or so that the harness cord (50) can be clamped in this second part (2).

The said passage (4) in the third part (3) is closed over at least part of its length and, between the portion which can be slid over the heddle (40) and the portion which can be slid over the harness cord or in which the harness cord can be clamped, is provided with a cross section (8) that is larger than the cross section of the continuous passage (4) in the first part (1) and in the second part (2).

Both at the bottom (heddle side) and at the top (harness cord side), the device is designed in a form whose cross section decreases towards the outer side (9), in order to reduce the action of the force of collisions between adjacent devices.

On top of a continuous passage (4) for guiding firstly a heddle (40) and secondly a harness cord, the device may also have features for introducing the connecting element (45).

The connecting element on top of the heddle can be introduced in two ways:

1) The connecting element (45) is not yet provided on the heddle when the heddle is guided through the passage (4) in the device. The connecting element (45) on top of the heddle is formed after the device has been slid over the heddle until the heddle (40) leaves the device in the second part (2) of the continuous passage. Then, the harness cord (50) is connected to the connecting element (45) and the connecting element (45) is introduced into the device from the top side (second part).
2) The connecting element (45) is already provided on the heddle (40) when the heddle (40) is being guided through the passage (4) in the device. In this configuration, the device must also have features on the heddle side (in the first part) for introducing the connecting element (45). The heddle (40) with connecting element (45) is slid transversely through the device, after which the harness cord (50) is connected to the connecting element and the connecting element is introduced back into the device at the top side (in the second part).

Figure 2A:
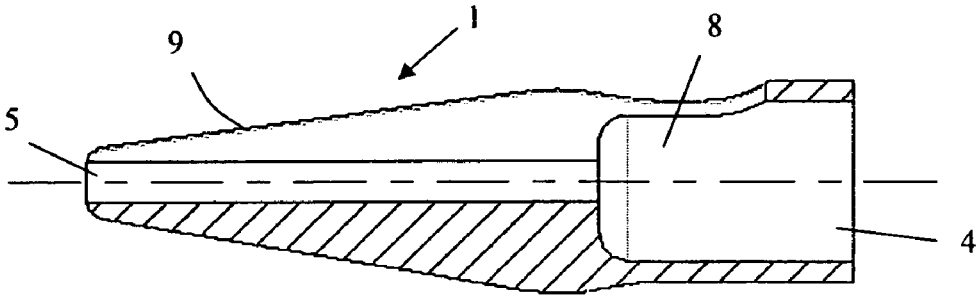
Figure 2B:
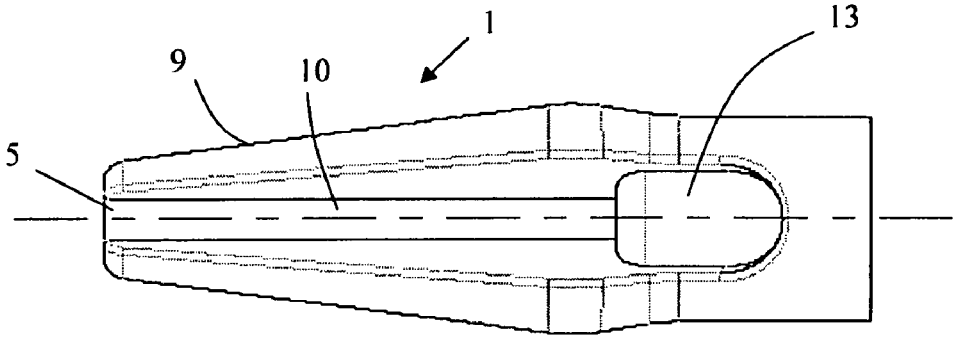
Figure 2C:
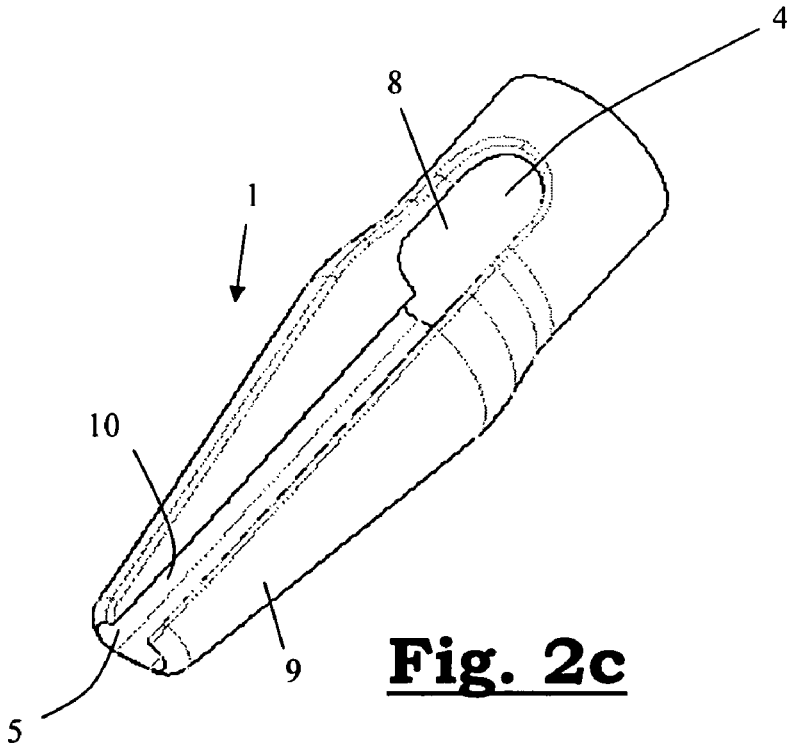
Figure 5A:
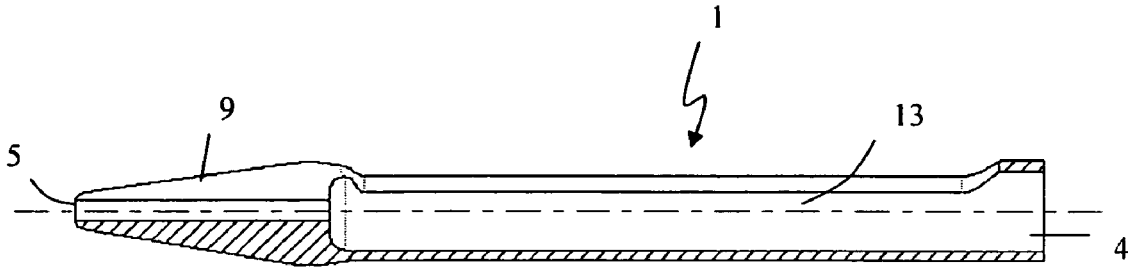
Figure 5B:
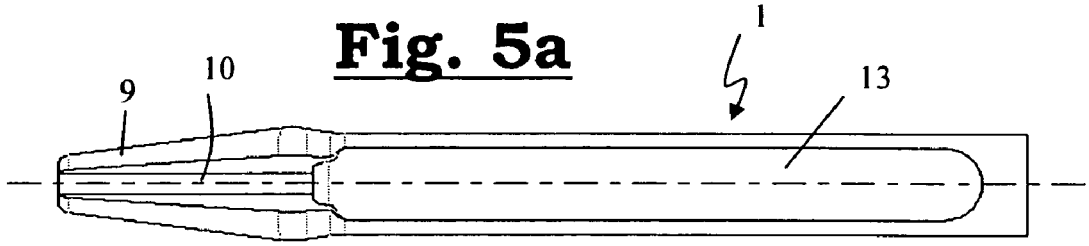
Figure 5C:
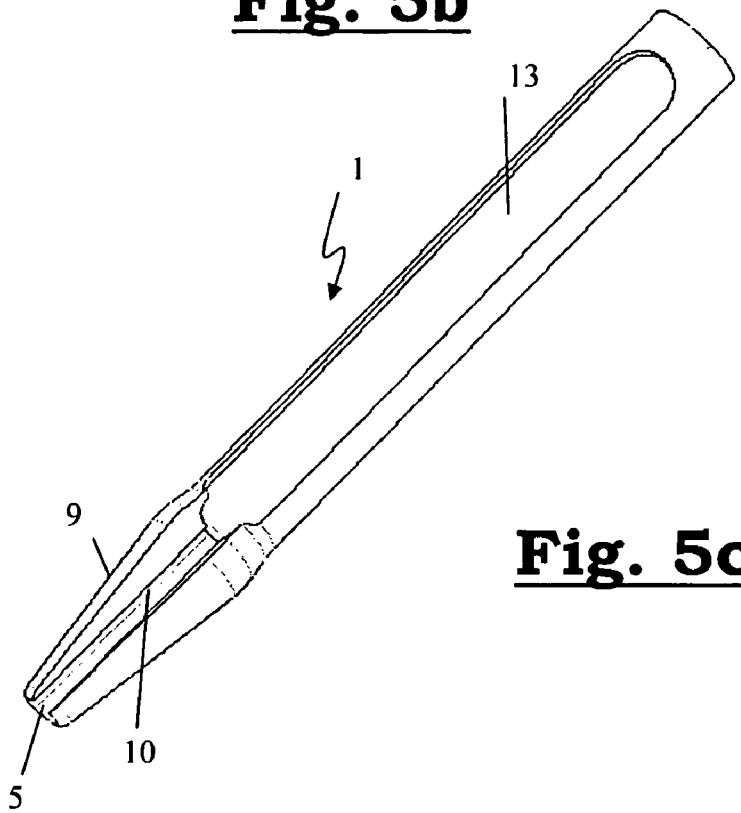

In order, as in configuration 2, for the heddle (40) with its connecting element (45) to be introduced from the heddle side, the first part (1) as illustrated in FIGS. 2 and 5 is provided with a groove (10) which extends from the bottom of the device into the portion of the passage (8) in which the cross section is larger than the cross section (5) in which the heddle (40) can slide.

Figure 3:
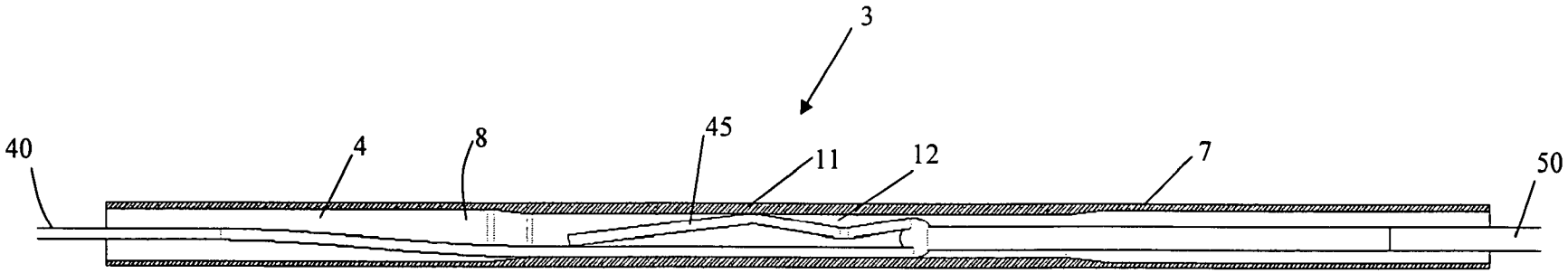

As illustrated in FIG. 3, the size of the cross section (8) of the passage (4) in the third part (3) can vary over the length of the third part (3). Since the connecting element (45) on the heddle permits elastic deformation in order to clamp the harness cord, the third part (3), over part of its length (11), preferably has a diameter of passage cross section (12) which has a clamping action on the connecting element on the heddle. This clamping action preferably takes place at the location where this portion of the device extends around the connection of the heddle connecting element (40, 45) to the harness cord (50), at the end of the cycle of fitting the device to the connection between heddle (40) and harness cord (50).

Figure 4:
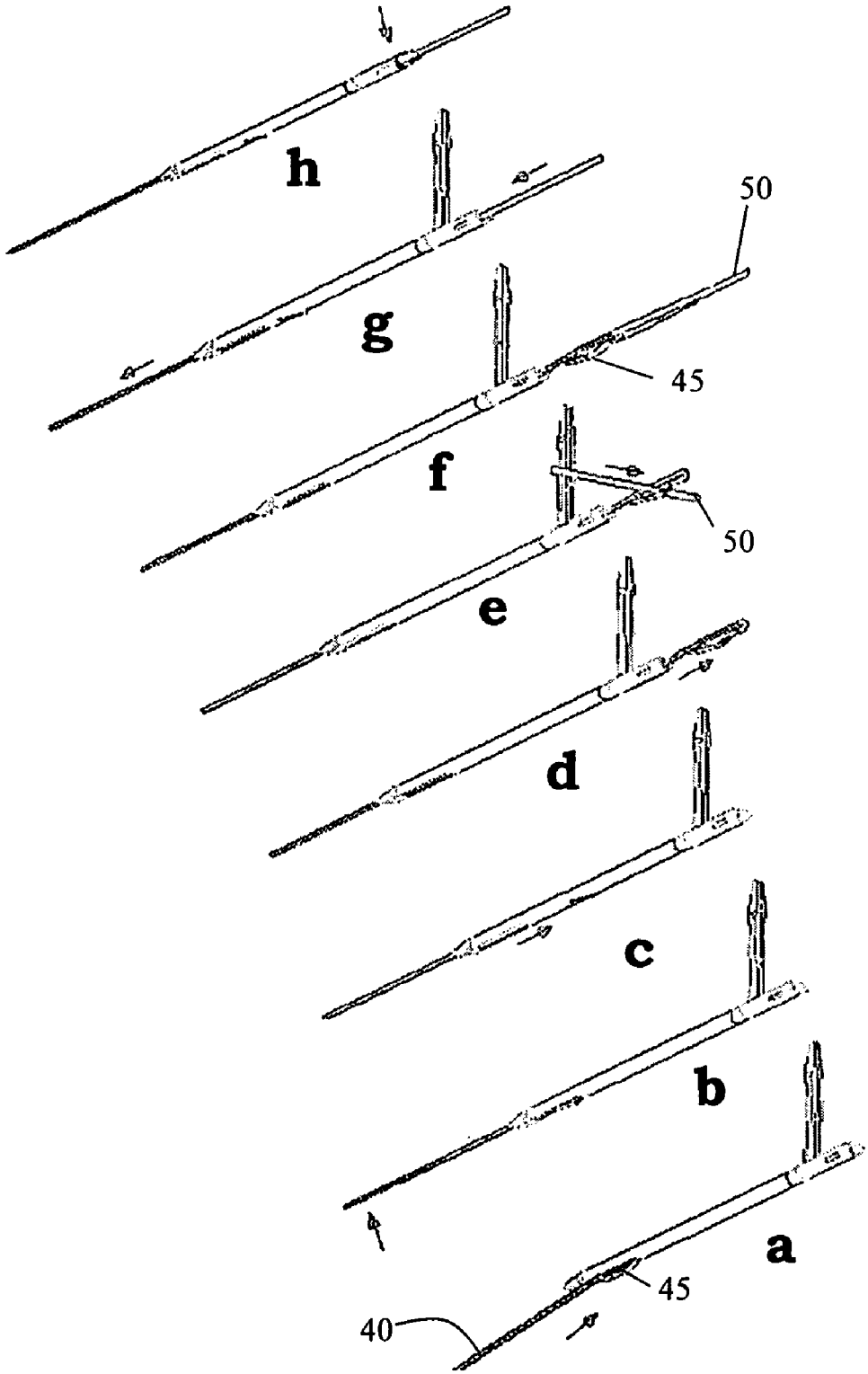

The various steps of realizing the connection of a heddle (40) to a harness cord (50) and locking this connection using a device according to the invention are illustrated in FIG. 4. The connecting element (45), together with the heddle, is inserted in the zone where the groove (10) extends into the portion (8) in which the passage (4) has a larger cross section than the cross section (5) in which the heddle can slide. In order subsequently to be locked in the device by clamping, the connecting element permits elastic deformation during its introduction into the device. Therefore, the connecting element (45) of the heddle can be introduced obliquely and in slightly compressed form over a limited groove length (13) in the larger cross section (8) of the continuous passage than the cross section (5) in which the heddle slides in the continuous passage (step a) in order, when the heddle is being placed back (step b), on the direction of the axis line of the continuous passage, for the heddle to slide further through the continuous passage (step c) until it emerges at the harness cord side (step d). There, after levelling, the harness cord (50) can be attached to the heddle (steps e-f) and pushed back into the device until the harness/heddle connection has been locked (step g).

In a preferred embodiment, the first part (1) comprises a second groove portion (13), which is designed to be wider than the groove (10) at the level of the cross section (5) in which the heddle slides. This is advantageous if, for example, the heddle comprises two wires located next to one another, with the result that the heddle has a cross section which is wider in one direction than in the other direction. If the connecting element on the heddle has a projection which is wider in a different radial direction, a wider groove (13) is useful since such a differently oriented widening can be inserted more easily. If the narrowest groove part (10) (first groove portion) has a width which is matched to the narrowest side of the heddle, a second groove portion (13) is required if the connecting element has a projection with a different orientation from the wide side of the heddle itself.

Both in configuration 1 and in configuration 2, it is necessary to provide features such that after the harness cord has been connected to the heddle above the device, the connecting element (45) on the heddle (40) with the harness cord (50) connected to it can be introduced into the continuous passage via the second part (2).

In a first embodiment (see FIGS. 1; *a, b* and *d*), the passage (4) in the second part is provided with a groove (14) in which the continuous passage ends with two edges each forming a lip (15). The lips (15) are designed in such a way that the harness cord (50) can be pushed through the lips (15) into the passage (4) by means of a compressive force, whereas a force greater than the lateral forces acting on the harness cord (50) during normal operation of the Jacquard weaving machine is required to remove the cord from the passage (4) through the lips (15). Towards the heddle side, the groove (14) has a widening (16) (second groove portion) in the portion where the passage (4) has a larger cross section (8) than the cross section (6) through which the harness cord can be slid. This widening (16) of the groove permits the connecting element (45) of the heddle, which after levelling has been connected to the introduced harness cord, to be introduced obliquely into the passage in the third part (3) of the continuous passage until the device is slid over the connecting element into the portion (11) in which the connecting element together with the harness cord is positioned in a sliding or clamping manner in the passage (4) in order for the harness cord (50) then to be received in clamping fashion in the second part (2) through the lips (15).

The device is simple and inexpensive to fit, since it comprises just one component. Furthermore, the connection can be opened again by exerting sufficient force on the harness cord for it to be pushed back out of the lips (15) along the groove (14) and for the connecting element (45) on the heddle (40) which is connected to the harness cord (50) to be pushed out of the continuous passage.

Figure 6:
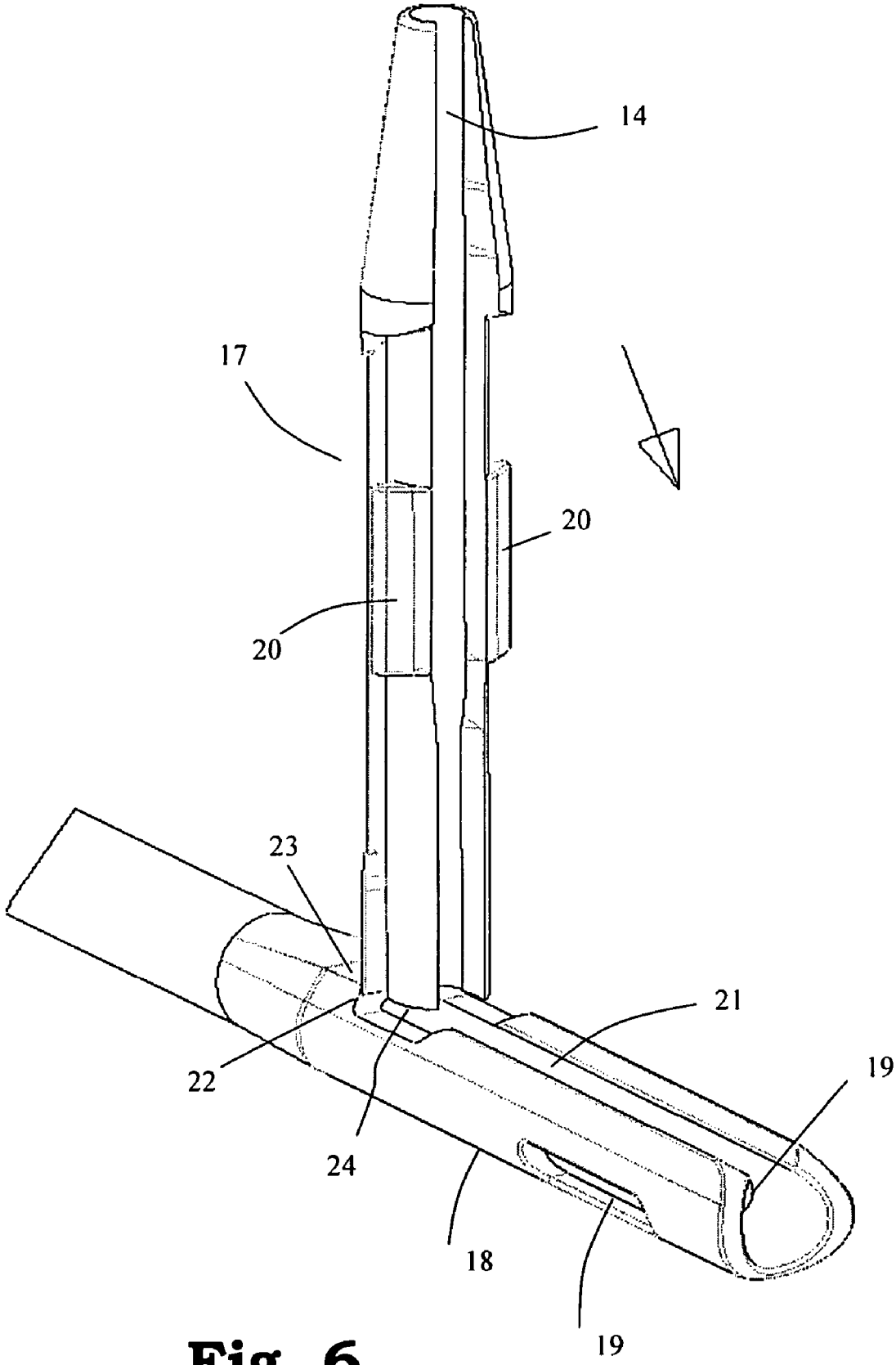
FIGS. 6, 7 and 8 illustrate a second part of the continuous passage, the device being designed as one component and part of this component being pivotably connected to the remainder of the component.
Figure 7A:
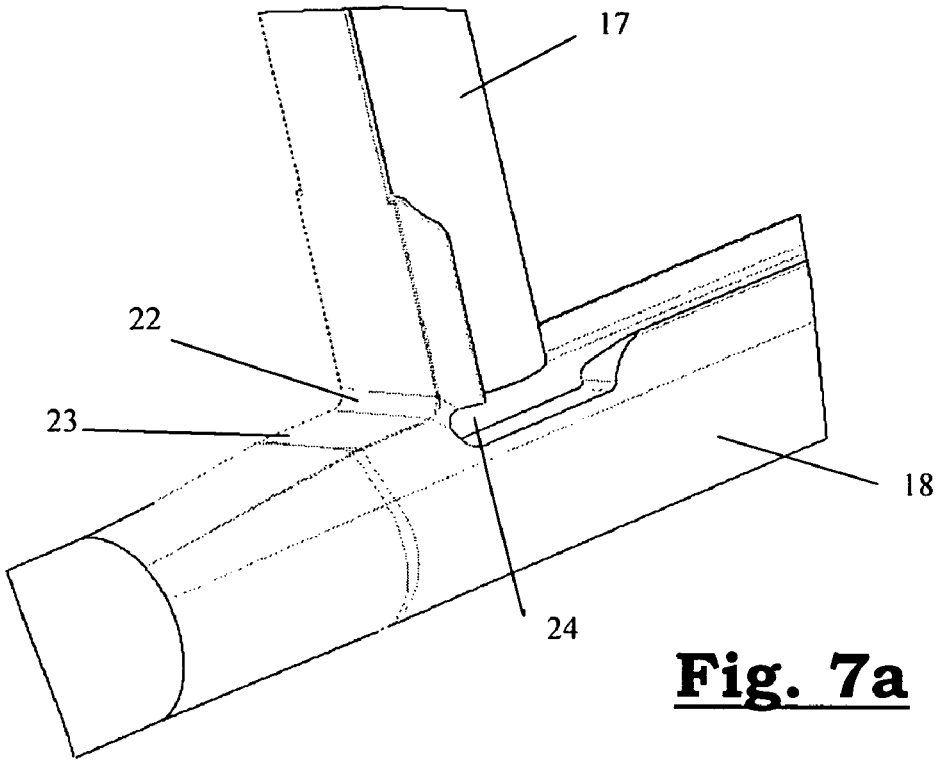
Figure 7B:
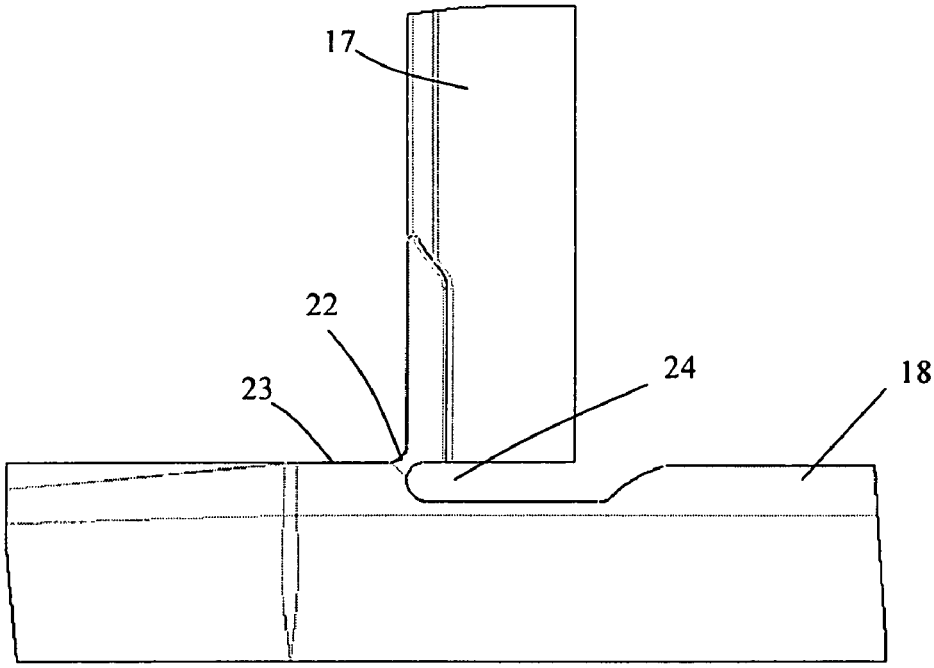

As illustrated in FIGS. 6 and 7, the second part may comprise a pivoting part (17) and a stationary part (18) (part above the pivoting connection) in order to receive the pivoting part (17) in clamping fashion, so that even during oblique introduction of the connecting element of the heddle to which the harness cord is connected, the harness cord can be inserted into the pivoting portion (17) and this pivoting part (17), together with the harness cord, can be folded towards the axis line of the continuous passage (which coincides with the direction in which the passage (4) extends). This embodiment makes it easier to introduce the harness cord into the axis line of the continuous passage.

The stationary part (18) exerts a clamping force on the pivoting part (17), so that the latter clamps the harness cord in its position in the passage (4, 6). This permits the harness cord to be inserted into the pivoting part (17) using lower compressive forces, in order to realize a significant clamping force on the harness cord (50) after the device has been closed by folding the pivoting part (17).

The pivoting part (17) is provided with one or more projections (20) which interact with one or more recesses (19), provided in the stationary part (18). This locks the device against loss of clamping on the harness cord. By pressing on the projections (20) through the recesses (19), it is possible for the pivoting part (17) to be released again from the stationary part (18), so that the pivoting part (17) can be folded open again and the harness cord can be removed and the connecting element of the heddle can be taken back out of the device and the connection released again. The reusability of the device after the connection has been opened is another significant benefit.

The stationary part (18) is provided with a guide groove (21) in order to guide the pivoting part (17) towards its clamping in the device, which is realized at least using the projections (20) which fit into the recesses (19). In addition to guiding the pivoting part (17) towards its clamping in the device, the said groove (21) can also exert an additional clamping action on the pivoting part (17). For this purpose, the stationary part (18) preferably has a wall thickness which varies over the circumference, the maximum wall thickness occurring perpendicular to the guide groove (21). In this way, the stationary part (18) is strongest in the positions at right angles to the groove, so that in this position the maximum force is exerted on the pivoting part and the harness cord is most securely clamped in this pivoting part after the pivoting part has been received in clamping fashion in the stationary part (18).

The pivoting connection (22) is preferably integrated in the plastic injection moulding, so that there are no additional components required to realize a pivoting connection (22). If the pivoting part (17) is moulded integrally in the plastics piece, the pivot line (22) is straighter and more aligned if the outer side of the device is provided with a flat side (23), with the pivot line forming part (22) of the flat side. This avoids in each case a different pivot line (22) being formed in the event of repeated pivoting and the pivoting portion (17) in each case also ending up at a different position. The pivot line (22) is even more clearly aligned if the guide groove (21) in the stationary part (18) has additional recesses (24) immediately after the pivot line (22).

Furthermore, the stationary part (18), in the longitudinal direction, may also be provided at the top with a projection which, when the pivoting part (17) is being folded shut, seals the groove (14), so that in the final assembled state the device is closed at one end, which offers the advantage of fewer sharp edges as a function of collisions with adjacent devices.

Figure 8:
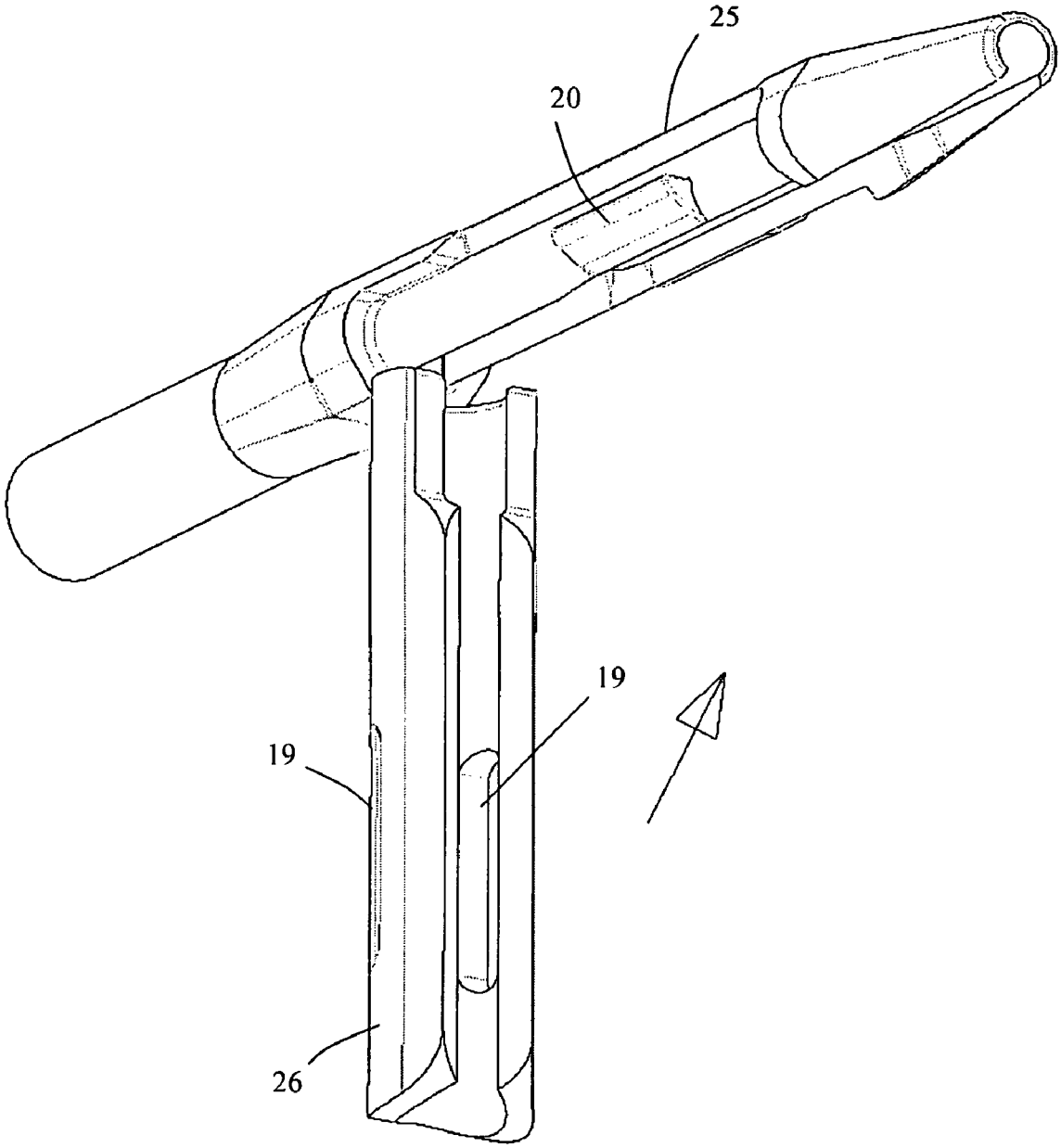

As illustrated in FIG. 8, it is also possible for the portion (25) on top of the device in which the harness cord can slide not to be pivotably connected, but rather fixedly connected, to the device, and instead for what has hitherto been referred to as the stationary part (18) to be provided (26) in pivoting form, in order, after levelling, to realize the connection between harness cord and heddle, for this connection to be introduced into the device, for the harness cord to be inserted in the portion (25) in which the harness cord can be slid and for the harness cord to be clamped further by folding the pivoting portion (26) closed. This method permits the heddle, which inherently has a certain elasticity, to bend to a lesser extent, since it can be introduced in a less oblique position than in the methods described above. This avoids deformation and damage to the heddles and increases the operating life time of the heddles.

Figure 9:
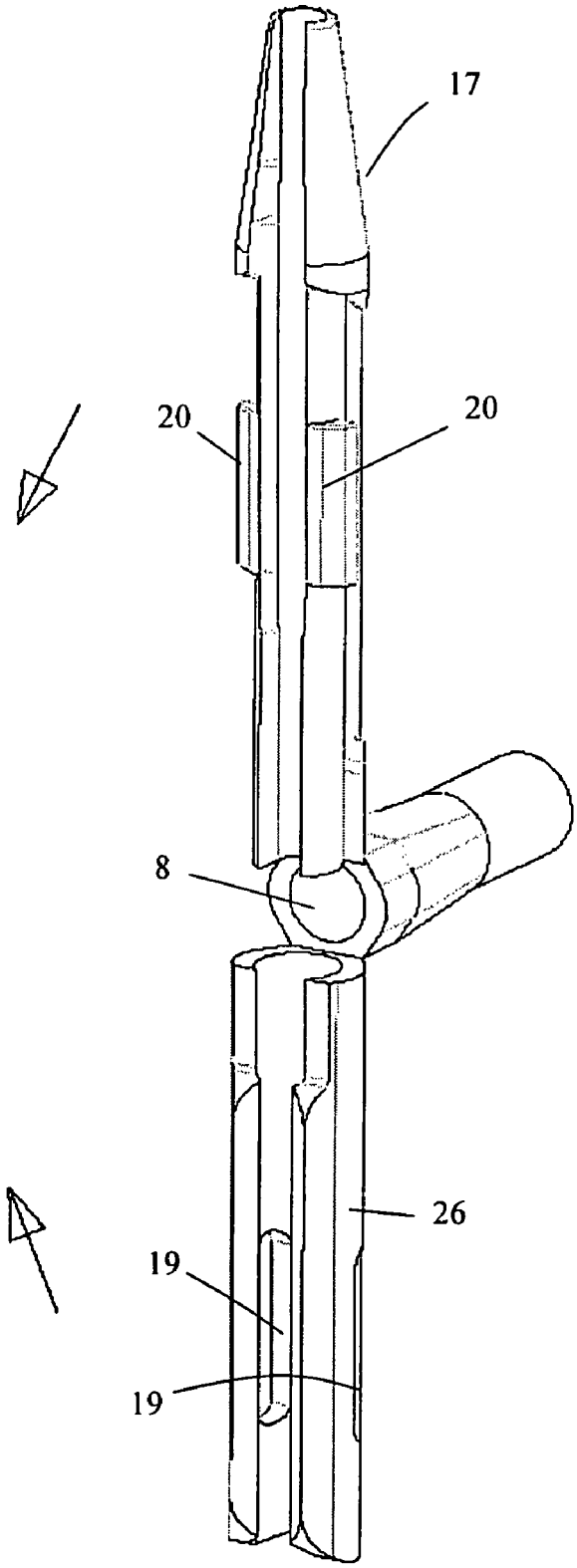
FIG. 9 illustrates a second part of the continuous passage, the device being designed as one component and two parts of this component being pivotably connected to the remainder of the component.

It is also possible (cf. FIG. 9) for both the portion (17) on top of the device in which the harness cord can be slid and the clamping portion (26) to be provided in pivoting form, and for the two to be folded towards one another in order to receive and clamp the harness cord. This makes it possible to avoid more properly the need for the heddle to be bent.

Figure 10C:
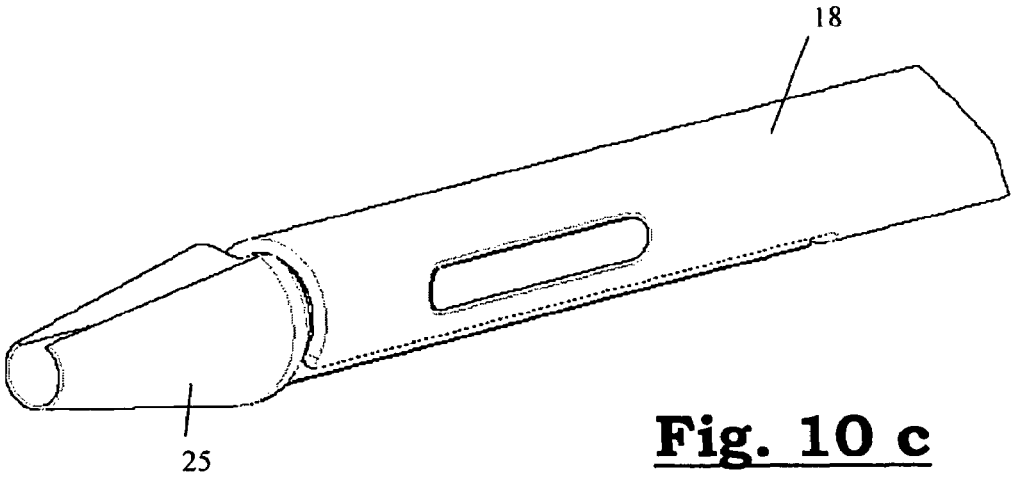
Figure 10B:
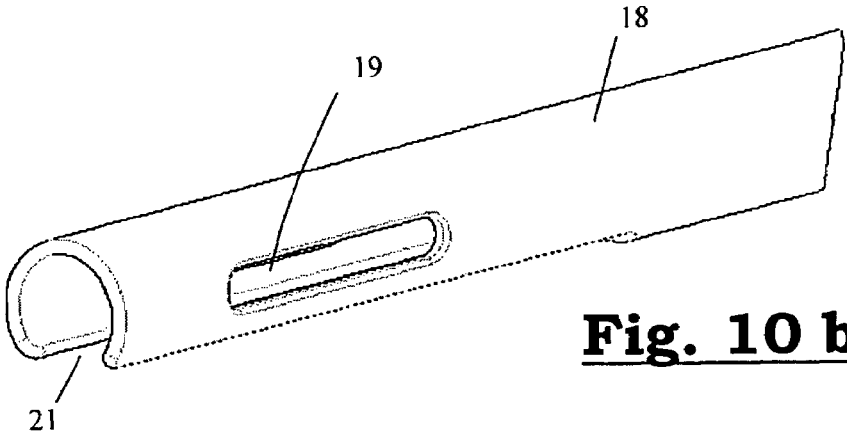
Figure 10A:
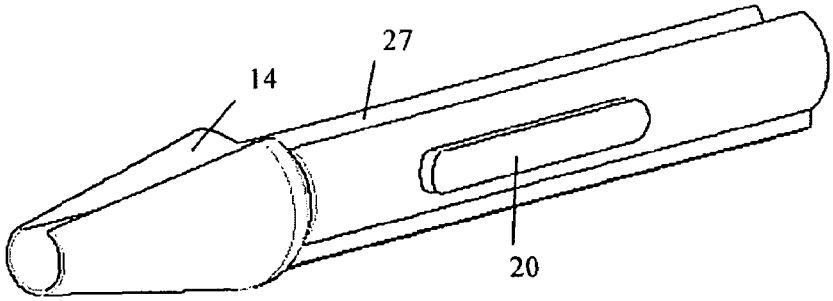
Figure 12C:
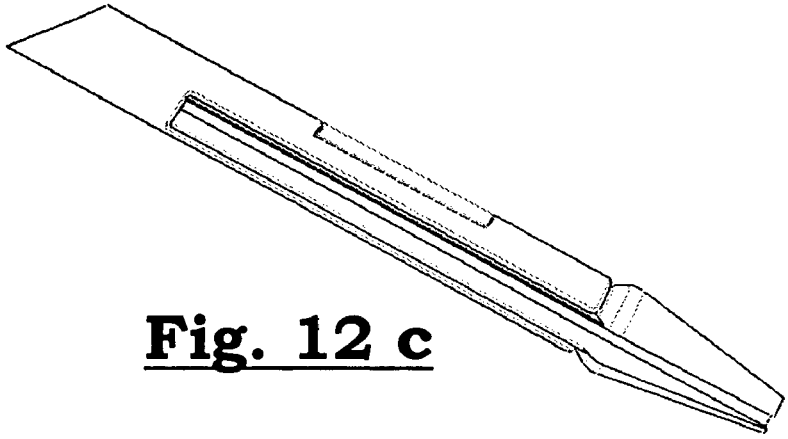
FIG. 12 illustrates a second part of the continuous passage, the device being designed as two components, the second component being pushed axially onto the first component in order to lock the connection between heddle and harness cord.
Figure 12B:
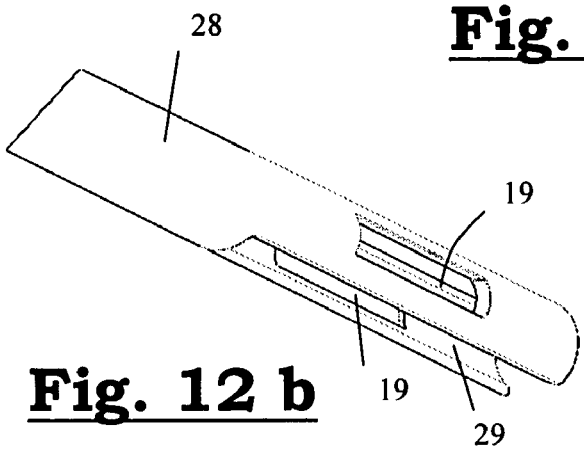
Figure 12A:
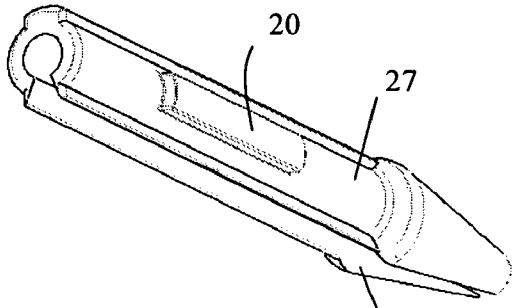

In another embodiment of the device according to the invention, and as illustrated in FIGS. 10 to 12, the device is composed of two components, of which one component also comprises the third part and the first part. In this case, neither the portion on top of the device in which the harness cord can be slid nor the clamping part which clamps the harness cord guide is of pivoting design. However, one of the abovementioned parts is provided as a separate component (27). This component (27) is intended to be click-fitted to the other part.

The second component can be secured radially (FIGS. 10 and 11). To this end, both components are provided with an axial groove (14, 21). Another securing option is illustrated in FIG. 12, where the second part (2) of the continuous passage, in which the harness cord can be slid, is provided as a separate component (27), and the clamping part (28), which is to receive the separate component, is provided with a narrower groove (29), and the portion on top of the device in which the harness cord can be slid is provided with a groove (14) for insertion of the harness cord and for pushing and clamping axially into the clamping part of the device by means of interaction of projections (20) and recesses (19); during the clamping of the two components, the harness cord is also additionally clamped in the inserted separate component (27).

It will be clear that a description is given here of first, second and third parts of the continuous passages according to the invention, which are also illustrated in the figures, and these parts can be combined with one another as desired in order in each case to obtain new variants of the inventions, by combining a first part, a second part and a third part.

The invention claimed is:

1. Device for locking the connection of a heddle (40) to a harness cord (50) comprising a heddle side and a harness cord side, wherein the device is composed of at most two different separable components that are separated from each other at any time during locking the connection of a heddle to a harness cord with the device or removal of the device from a heddle and harness cord, the device having a diameter on the heddle side and on the harness cord side which decreases towards the end until the diameter virtually matches the heddle or the harness cord, respectively, and the device being releasable and recloseable.

2. Device according to claim 1, characterized in that the components which form the device are each made from a plastics material which has a high wear resistance.

3. Device according to claim 2, characterized in that the device is made from polypropylene, polyandde and/or polyacetal.

4. Device according to claim 1, characterized in that the device is provided over virtually its entire length with a continuous passage (4) for guiding a heddle (40) and a harness cord (50), the continuous passage (4) being composed of a:

first part (1) provided on the side where the heddle (40) enters the device in the final assembled state;

second part (2) provided on the side where the harness cord (50) enters the device in the final assembled state;

a third part (3), located between the said first part (1) and second part (2).

5. Device according to claim 4, characterized in that the said passage (4) in the first part (1) is provided, over at least part of its length, with a passage cross section of a shape which virtually corresponds to the shape of the cross section of the heddle (5).

6. Device according to claim 4, characterized in that the said passage in the second part (2) is provided, over at least part of its length, with a passage cross section of a shape which virtually corresponds to the shape of the cross section of the harness cord (6).

7. Device according to claim 4, characterized in that the said passage (4) in the third part is closed (7) over at least part of its length, and in that the third part (3) has a larger passage cross section (8) than the passage cross sections of the first and second parts.

8. Device according to claim 4, characterized in that the passage cross section (8) of the third part (3) is variable.

9. Device according to claim 8, characterized in that the third part (3) has, over at least part of its length (11), a passage cross section (12) with a smaller diameter than the larger passage cross section (8) of the third part (3), which is intended to act in a clamping manner on a connecting element (45) provided on the heddle.

10. Device according to claim 4, characterized in that the first part (1) and/or the second part (2) comprises a groove (10), (14), connected to the continuous passage (4).

11. Device according to claim 10, characterized in that the said groove (10), (14) comprises a first groove portion and a second, adjacent groove portion (13), (16) with a greater width than the first groove portion, the first groove portion being located at one end of the device.

12. Device according to claim 1, characterized in that the second part is provided with at least two lips (15) at its end.

13. Device according to claim 4, characterized in that the device has no separable components.

14. Device according to claim 13, characterized in that the second part (2) comprises at least one pivoting part (17) for receiving the harness cord (50) in the second part (2) of the continuous passage.

15. Device according to claim 13, characterized in that the second part (2) comprises a pivoting part (17) and a stationary part (18), the stationary part (18) being provided for the purpose of holding the pivoting part (17) in a fixed position.

16. Device according to claim 15, characterized in that the pivoting part (17) is provided with one or more projections (20) which fit into corresponding openings (19) in the stationary part (18), in such a manner that the stationary part (18) can hold the pivoting part (17) clamped in a fixed position.

17. Device according to claim 15, characterized in that the stationary part (17) comprises a guide groove (21) for guiding the pivoting part towards the stationary part (18).

18. Device according to claim 17, characterized in that the stationary part (18) has a wall thickness which varies over the circumference, the maximum wall thickness occurring at right angles to the guide groove (21).

19. Device according to claim 14, characterized in that at the transition from the pivoting part (17) of the second part (2) of the continuous passage to the fixed third part (3) of the continuous passage, the pivoting second part (17) and/or the fixed third part are provided on the outer side with a flat side (23), with the pivot line (22) between the two parts forming part of said flat side(s).

20. Device according to claim 2, characterized in that the device is produced by an injection-moulding process.

21. Device according to claim 1, characterized in that the second part is composed of two separable components, one component also comprising the first part (1) and the third part (3).

22. Device according to claim 21, characterized in that the said components are connected to one another via a click-fit connection.

23. Device according to claim 22, characterized in that the said components are provided with an axial groove (14, 21) for radially connecting the said components to one another.

24. Device according to claim 21, characterized in that the second part (2) is composed of a separate component (27), which is provided with a groove in which the harness cord can be slid, and a clamping component (18, 25), of which the third part (3) and the first part (1) also form part, the clamping component being provided with a groove (29) for axially connecting the said components to one another.

25. Device according to claim 24, characterized in that the separate component (27) comprises one or more projections (20) which fit into corresponding openings (19) in the clamping component, in such a manner that the clamping component can exert a clamping force on the axially inserted separate component (27).

26. Method for locking the connection of a heddle (40) to a harness cord (50), characterized in that a device comprising a heddle side and a harness cord side, wherein the device is composed of at most two different separable components that are separated from each other at any time during locking the connection of a heddle to a harness cord with the device or removal of the device from a heddle and harness cord, the device having a diameter on the heddle side and on the harness cord side which decreases towards the end until the diameter virtually matches the heddle or the harness cord, respectively, and the device being releasable and recloseable, is used to lock the connection of a heddle (40) to a harness cord (50).

27. Jacquard weaving machine provided with a harness device, characterized in that a device according to claim 1 is used to lock the connection of a heddle (40) to a harness cord (50).

* * * * *